US006354127B1

(12) United States Patent
Rossini

(10) Patent No.: US 6,354,127 B1
(45) Date of Patent: Mar. 12, 2002

(54) STRAIGHTENER FOR ROLLED FERROUS PRODUCTS, HAVING HORIZONTALLY OPENABLE SHOULDERS FOR FAST CHANGE OF THE ROLLS

(75) Inventor: Marco Rossini, Olgiate Olona (IT)

(73) Assignee: Techint Compagnia Tecnica Internazionale S.p.A., Milan (IT)

( * ) Notice: Subject to any disclaimer, the term of this patent is extended or adjusted under 35 U.S.C. 154(b) by 0 days.

(21) Appl. No.: 09/549,251

(22) Filed: Apr. 14, 2000

(30) Foreign Application Priority Data

Apr. 28, 1999 (IT) ..... MI99A0894

(51) Int. Cl.[7] ..... B21D 1/14; B21B 31/08
(52) U.S. Cl. ..... 72/164; 72/239; 72/248
(58) Field of Search ..... 72/239, 164, 165, 72/160, 248

(56) References Cited

U.S. PATENT DOCUMENTS

| | | | | | |
|---|---|---|---|---|---|
| 1,537,240 | A | * | 5/1925 | Lewis | 72/248 |
| 1,576,266 | A | * | 3/1926 | Biggert | 72/248 |
| 1,730,642 | A | * | 10/1929 | Budd | 72/248 |
| 4,368,633 | A | * | 1/1983 | Nogota | 72/239 |
| 4,552,007 | A | * | 11/1985 | Mantovan | 72/239 |
| 4,641,511 | A | * | 2/1987 | Poloni | 72/239 |
| 4,905,493 | A | * | 3/1990 | Benedetti | 72/239 |
| 5,195,345 | A | * | 3/1993 | Porombka | 72/239 |

FOREIGN PATENT DOCUMENTS

| | | | | |
|---|---|---|---|---|
| GB | 928030 | * | 6/1963 | 72/239 |
| JP | 168409 | * | 10/1983 | 72/239 |

* cited by examiner

*Primary Examiner*—Daniel C. Crane
(74) *Attorney, Agent, or Firm*—Hedman & Costigan, P.C.

(57) ABSTRACT

The invention refers to a straightener for rolled ferrous products, of the type in which a framework (11) comprises a pair of opposed shoulders (12, 13) which support two sets of rolls, a top set (14) and a bottom set (15), which define between them a straightening path for straightening said rolled products. According to the invention, said opposed shoulders (12, 13) may be translated horizontally between a closed, operative, position of containment and support of said rolls (14, 15), and an open, non-operative, position, in which said sets of rolls (14, 15) may be removed for replacement with other sets of different rolls. Moreover provided are supporting and transporting means, which are independent of the aforesaid framework (11), for supporting said sets of rolls (14, 15) in said open, non-operative, position of the shoulders (12, 13).

7 Claims, 9 Drawing Sheets

Fig.3
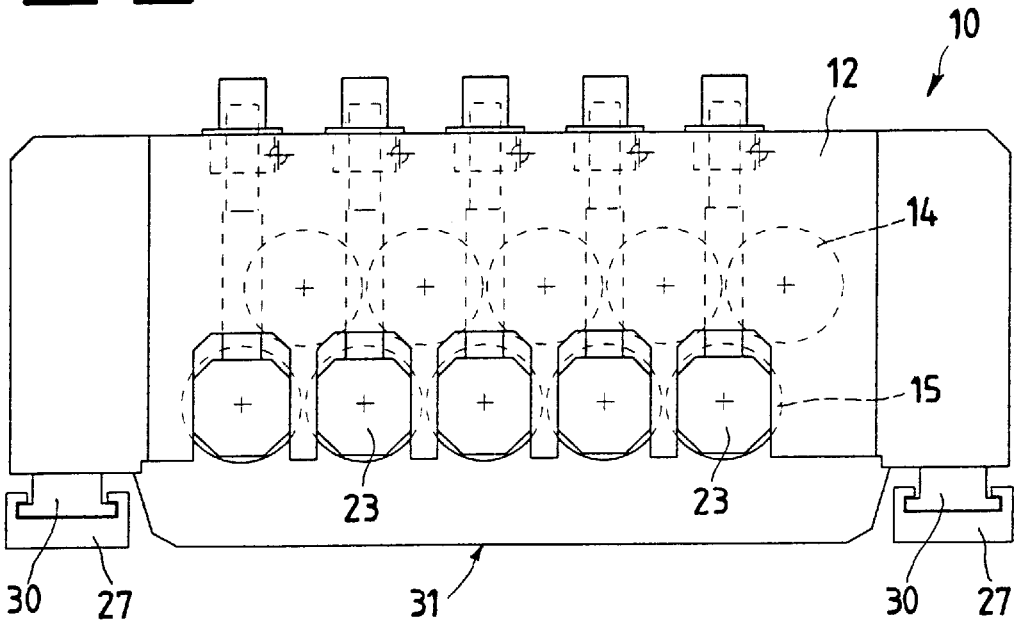
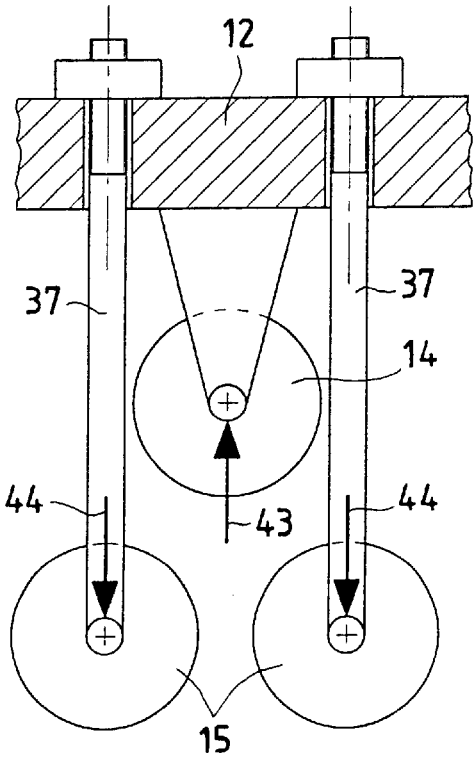
Fig.4A 10
18
19
20
28
39
40
30
12
45
25
24
27
31
36
14
13
29

STRAIGHTENER FOR ROLLED FERROUS PRODUCTS, HAVING HORIZONTALLY OPENABLE SHOULDERS FOR FAST CHANGE OF THE ROLLS

The present invention refers to a roller straightener for rolled ferrous products, the shoulders of which are characteristically openable by means of horizontal translation (relative separation of the shoulders) for the purpose of fast changing of the rolls.

As is well known to experts of the rolling sector, in general downstream of the cooling plate of a rolling system a straightener is set which has the purpose of making the rolled ferrous products perfectly rectilinear, for example, bars or other section pieces (angle bars, etc.).

Briefly, a straightener is a machine comprising a plurality of bottom rolls and a plurality of top rolls carried by holsters. Between the said rolls (which are set with their axes parallel) are fed the pieces to be straightened arriving from the rolling process.

The bottom rolls are generally the motor-driven ones, whilst the top rolls are driven in rotation by the rolled product, which is fed between the two rows of rolls.

The shell of the said bottom and top rolls is appropriately shaped (grooved), with a configuration suited to the processing of the product coming from the rolling mill.

The distance (gap) between the top rolls and the bottom rolls is adjustable so as to enable straightening of rolled products within a certain size range.

Straighteners of a known type are, for example, described and illustrated in the Italian patents Nos. 1.205.129 and 1.205.130.

An important requirement that a straightener of the above-mentioned type must satisfy is the possibility of changing the rolls in the simplest and fastest way possible when there arises the need to straighten rolled products having profiles and/or dimensions that are considerably different from the ones currently being processed.

In straighteners of a known type, such an operation requires the replacement of the entire ensemble of rolls (top and bottom) with another one having rolls with a different configuration.

The replacement of the entire set of rolls involves stoppage of the straightening machine, removal of the rolls currently in place, and installation of new sets of top and bottom rolls. However, such a solution is long, laborious and costly.

In fact, in straighteners of the known type, the supports for the bearings of the rolls are integral with the holsters of the machine, whereas the bearings proper, during the disassembly phase, remain fixed to the shafts of the rolls themselves.

Consequently, there exists the following alternative: either each roll is equipped with its own bearings, or the bearings of the rolls that are removed must be disassembled and re-assembled on the new rolls, with all the evident operating problems that derive therefrom.

The Italian patent No. 1.205.130 proposes a solution to the problem with a straightener the framework of which carries a plurality of bottom rolls and a plurality of top rolls defining a straightening path.

According to the above patent, some of the aforesaid rolls have a smaller diameter, and others have a larger diameter, in order to form two sets of rolls of different diameters, the sets being arranged one after the other. Also provided are means for moving away the said rolls of smaller diameter from the said straightening path, or inserting them in the said path according to the transverse dimensions of the section bar to be straightened.

However, also such a solution has proved very costly since, in practice, it entails two machines in line.

A further drawback of the machines of the known type is represented by the fact that the top holsters support and withstand the forces acting on all the top rolls, whilst the bottom holsters support and withstand the forces acting on all the bottom rolls. In addition, the arrangement of the top and bottom rolls is such that the forces generated by the operation of straightening the rolled products are discharged in the sense that they cause the rolls themselves to move away from one another, with the result that the structures have to support the sum of the forces acting on all the top rolls and on all the bottom rolls. This leads to the drawback of having a very extensive structure outside all the rolls, so that a very long path is created for closing the stresses.

A general purpose of the present invention is therefore that of solving, in a simple and economic way, the problem of roll change in a roller straightener for bars and/or section pieces coming from a rolling mill.

Another purpose of the invention is to create a straightener that is structured in such a manner that the forces generated by the straightening operation on the rolled products are discharged on the resistant structure so as to close, with a short path, on themselves in groups of three rolls.

The above-mentioned purposes are achieved by a straightener having the characteristics presented in the attached main claim and in the dependent claims.

The structural and functional characteristics of the invention and its advantages with respect to the known art will emerge clearly understandable from an examination of the following description, which refers to the attached schematic drawings showing examples of practical embodiment of the invention itself. In the drawings:

FIG. 3 is a view like that of FIG. 1 illustrating the top, fixed, rolls, the bottom, adjustable, rolls, and the guides for opening the shoulders;

FIG. 4A is a schematic representation of the two bottom rolls and of the top roll (that of FIG. 4) corresponding to them, which illustrates the principle of closing of the forces on the load-bearing shoulders in each set of three rolls;

Figure 1:
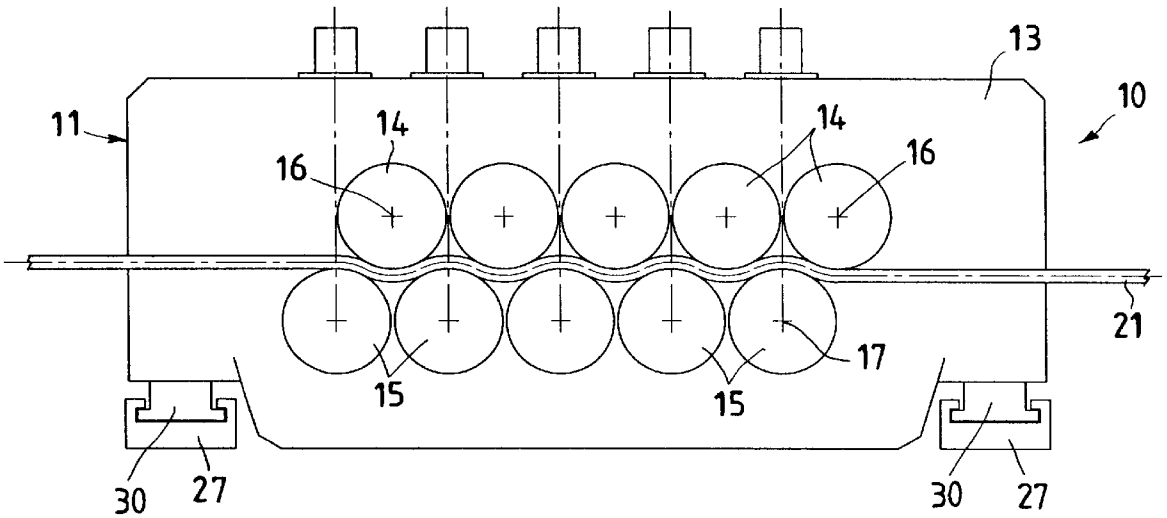
FIG. 1 is a longitudinal front view illustrating a roller straightener, between the rolls of which a product to be straightened is fed.

In the drawings, the straightener in question is designated as a whole by 10, and is structurally made up of a framework 11 comprising a pair of shoulders 12, 13 set opposite to one another, which support two sets of rolls, a top set 14 and a bottom set 15.

As may be clearly seen from the drawings, the axes 16, 17 of the rolls 14, 15, respectively, are staggered, lying on the median plane between two consecutive rolls. Consequently, the top rolls 14 are positioned in the spaces defined by the distance between axes of the corresponding bottom rolls 15.

In the example shown, the top rolls 14 are motor-driven, whereas the bottom rolls 15 are idle. Motion is transmitted to the rolls 14 by means of a motor assembly 18, a reducer 19, and extension arms 20, all of which are of a known type and are hence not described in greater detail herein.

Figure 4:
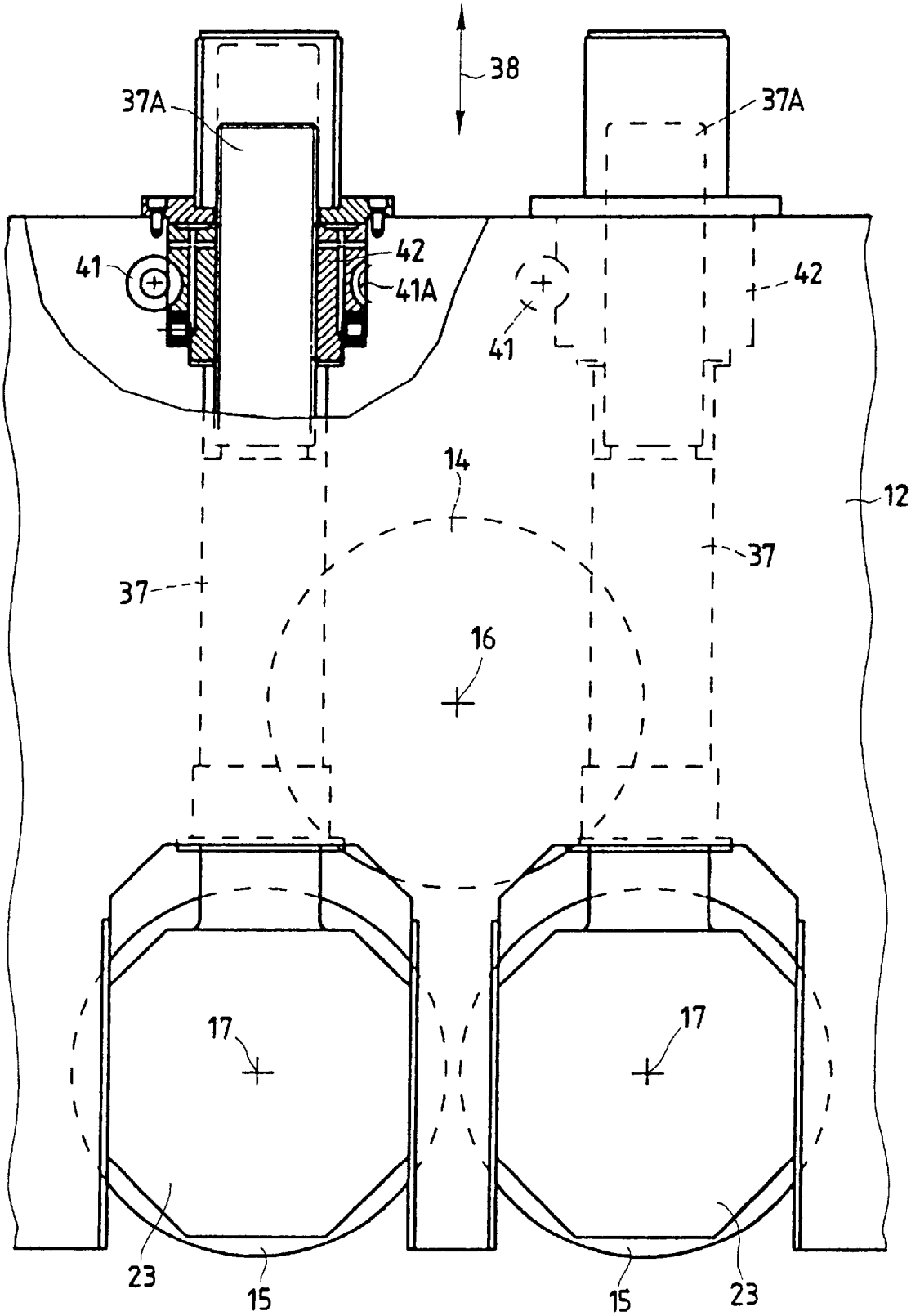
FIG. 4 is a partially cut-away and sectioned enlarged detail illustrating the bottom, adjustable, rolls of FIG. 3 and the corresponding adjustment system, where a top roll is represented with a dashed line.
Figure 10:
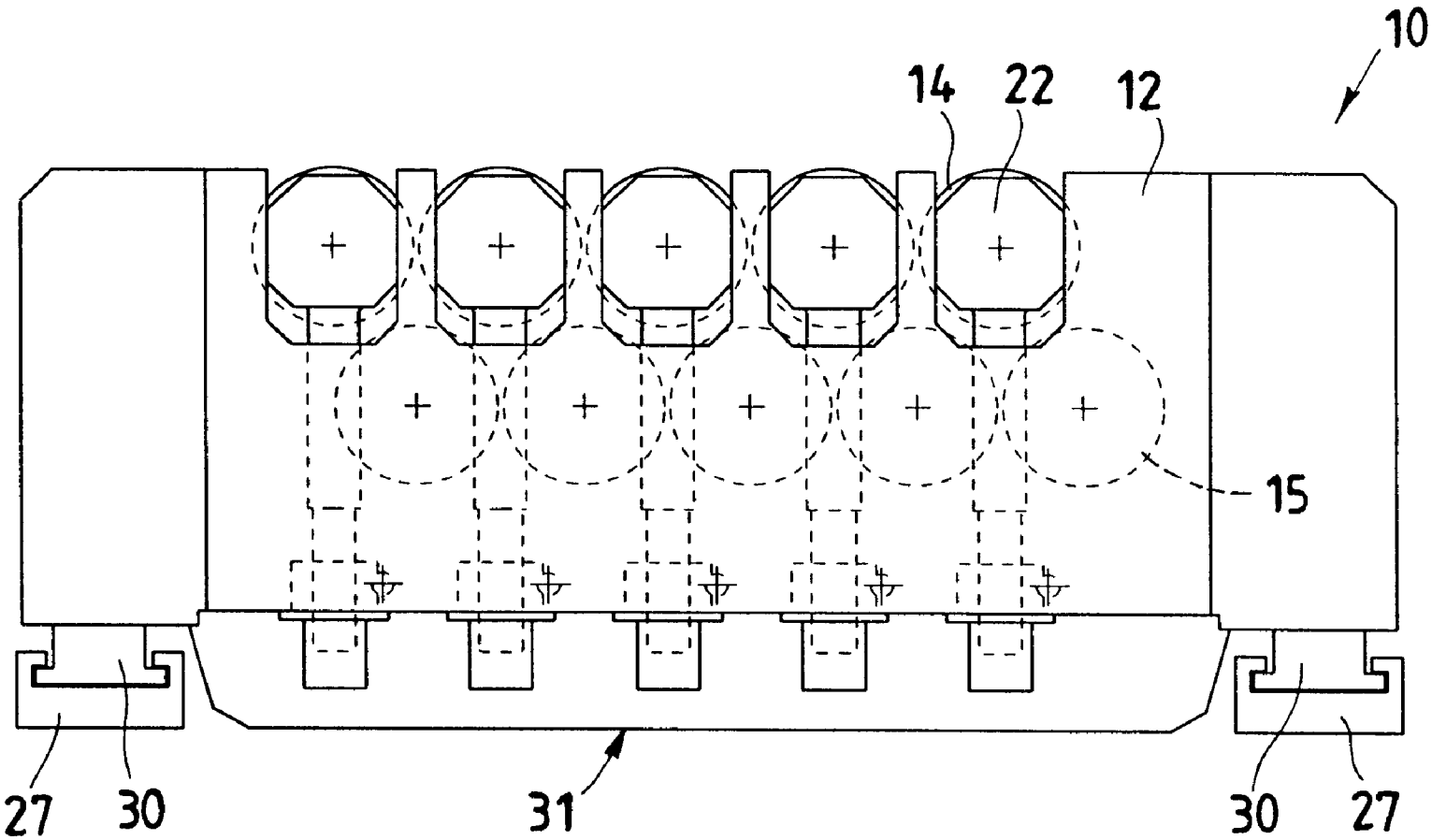
FIG. 10 is a view similar to FIG. 3, illustrating a possible variant where the bottom rolls are fixed and the top rolls are position-adjustable.

As shown in FIGS. 4 and 10 of the drawings and as explained hereinafter, the rolls 15, 14 are position-adjustable with respect to one another so as to enable variation of the distance between their axes, and consequently of the distance (gap) between the rolls themselves.

Figure 2:
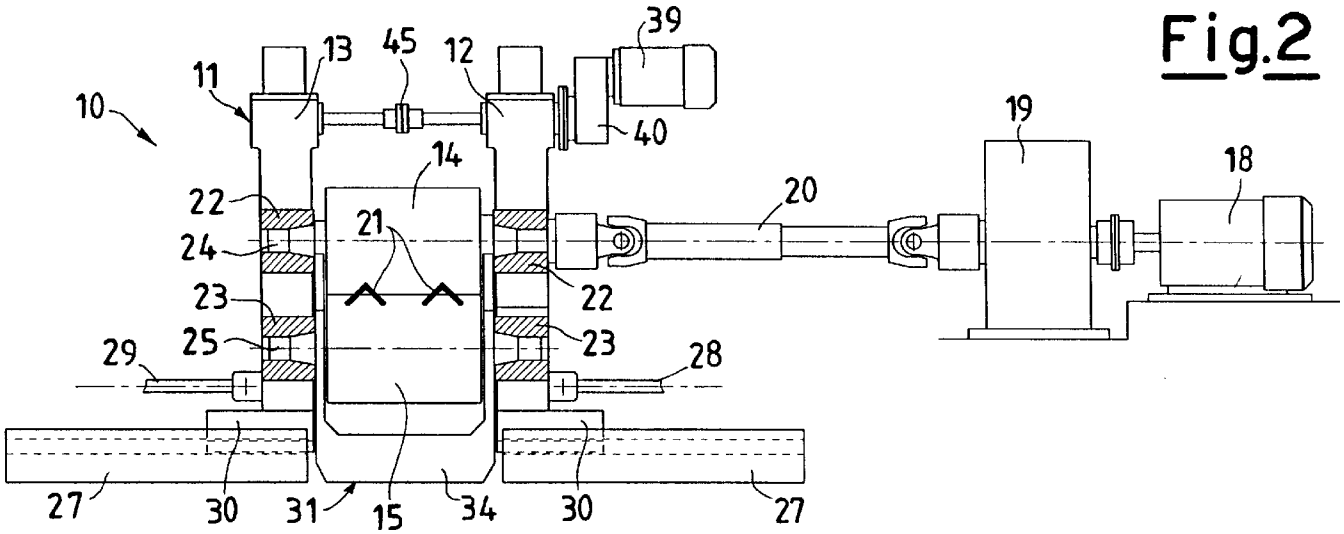
FIG. 2 is a partially sectioned side view of the straightener of FIG. 1.

The reference number 21 designates a rolled product to be straightened which is fed through the sets of rolls 14, 15. The said rolled product 21 may have, for example, an angle section, as shown in FIG. 2, so that the rolls 14, 15 will have corresponding seats.

As may be clearly seen from the drawings, the operation of straightening of the rolled product 21 takes place between sets of three rolls 14, 15, i.e. one top roll and two bottom rolls, or vice versa.

According to the present invention, the rolls 14, 15 are carried by shoulders 12, 13 in which bearings 22, 23 are stably mounted, which receive the shafts 24, 25—with necks which have a shape that is partially cylindrical and partially that of a truncated cone—of the rolls 14, 15 themselves.

Figure 5:
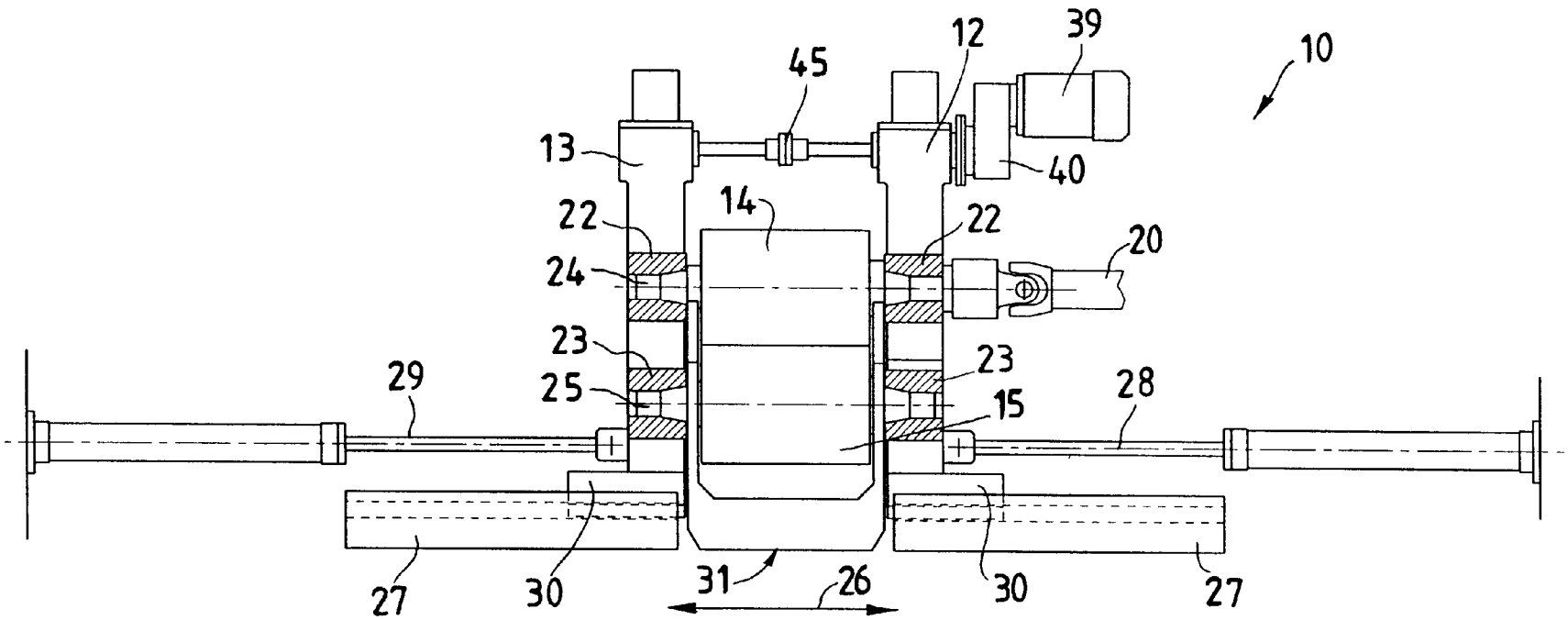
FIG. 5 is a side view illustrating the straightener in the working position (shoulders closed)
Figure 7:
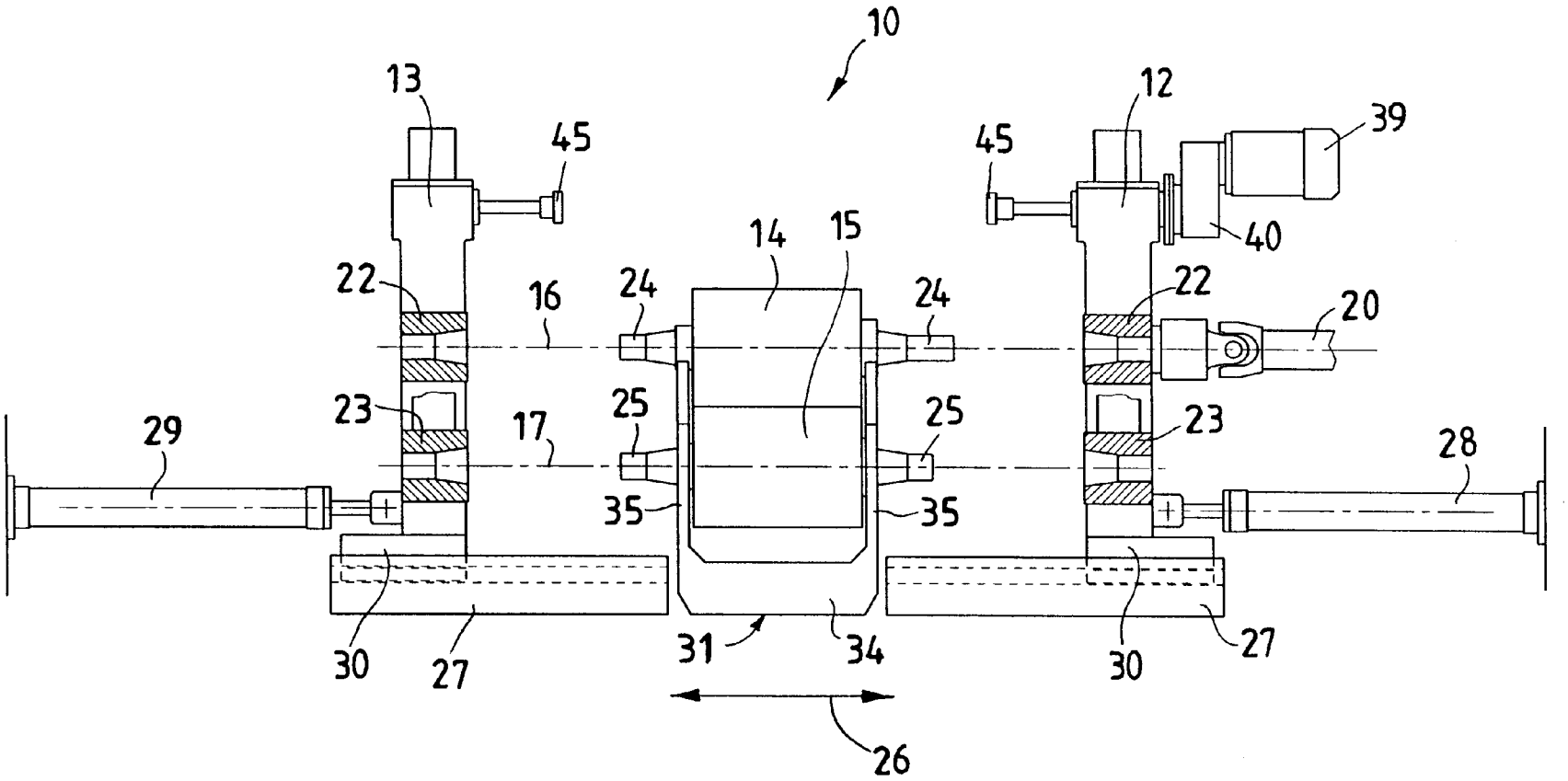
FIG. 7 is a side view illustrating the same straightener as in FIG. 5 in the roll-change position (shoulders open horizontally)

In addition, the said shoulders 12, 13 may be translated in the direction of the arrow 26 on rails 27, as shown in FIGS. 5 and 7.

The translation of the shoulders 12, 13 is governed by respective hydraulic jacks 28, 29.

For their translation the shoulders 12, 13 are each provided with a foot 30 which mates with the rail 27, as illustrated schematically in the drawings.

Figure 6:
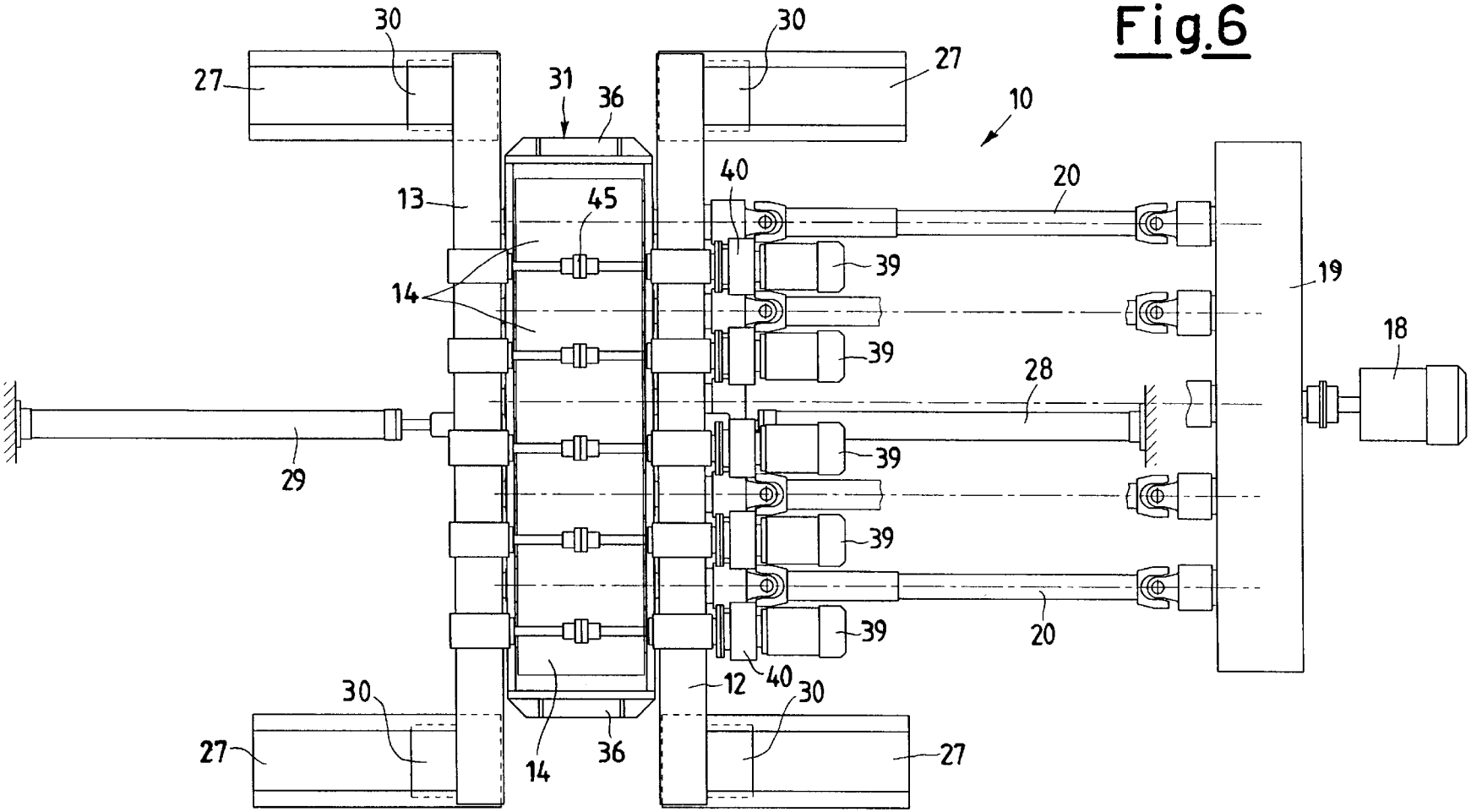
FIG. 6 is a plan view of the same straightener as in FIG. 5 in the working position.
Figure 8:
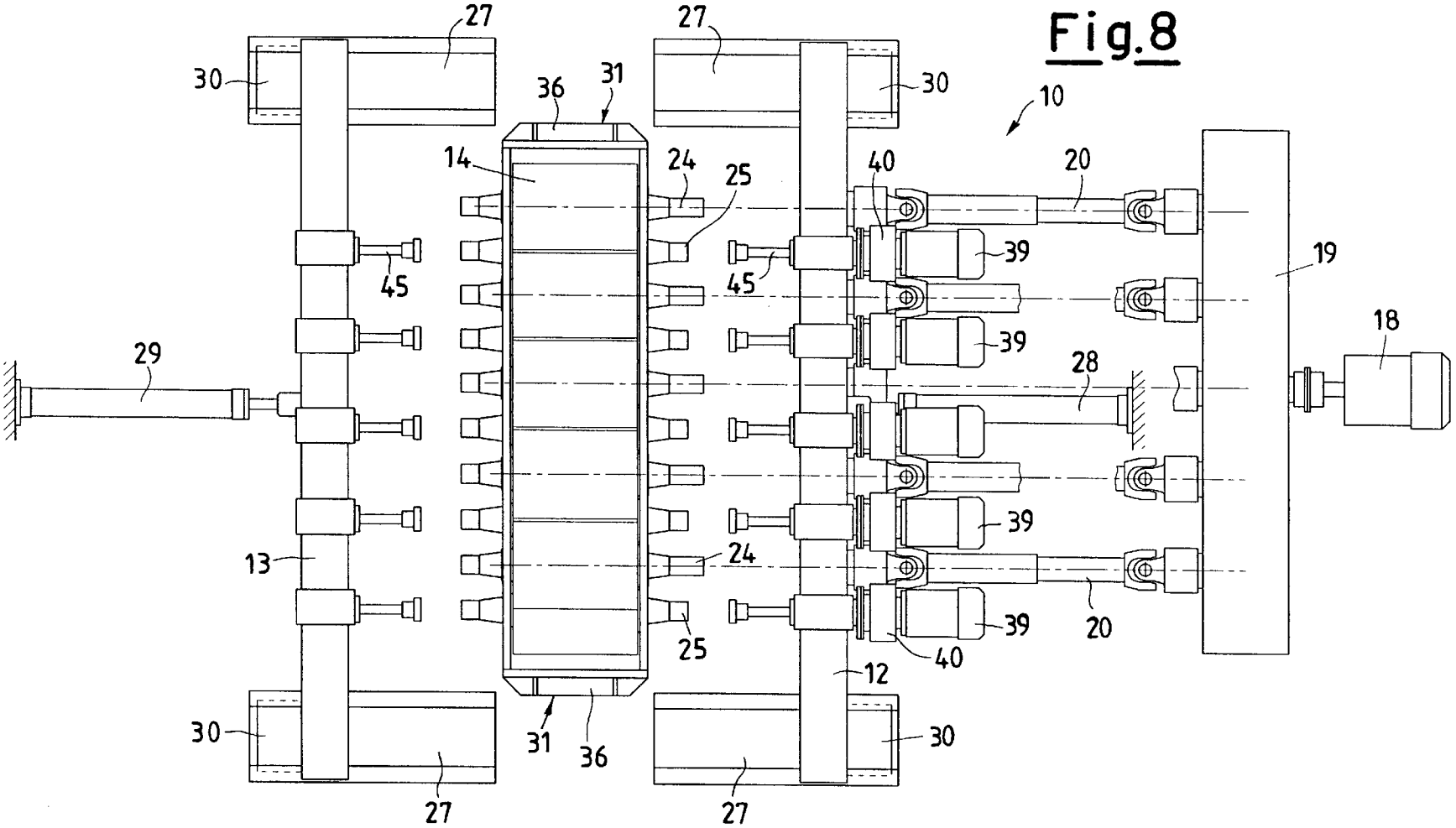
FIG. 8 is a plan view of the same straightener of FIG. 7 in the roll-change position.

As may be clearly seen from the figures, when necessary replacement of the sets of rolls 14, 15 may be carried out easily and rapidly just by opening the shoulders 12, 13 from the closed position, as shown in FIGS. 5 and 6, to the open position, as shown in FIGS. 7 and 8.

Figure 9:
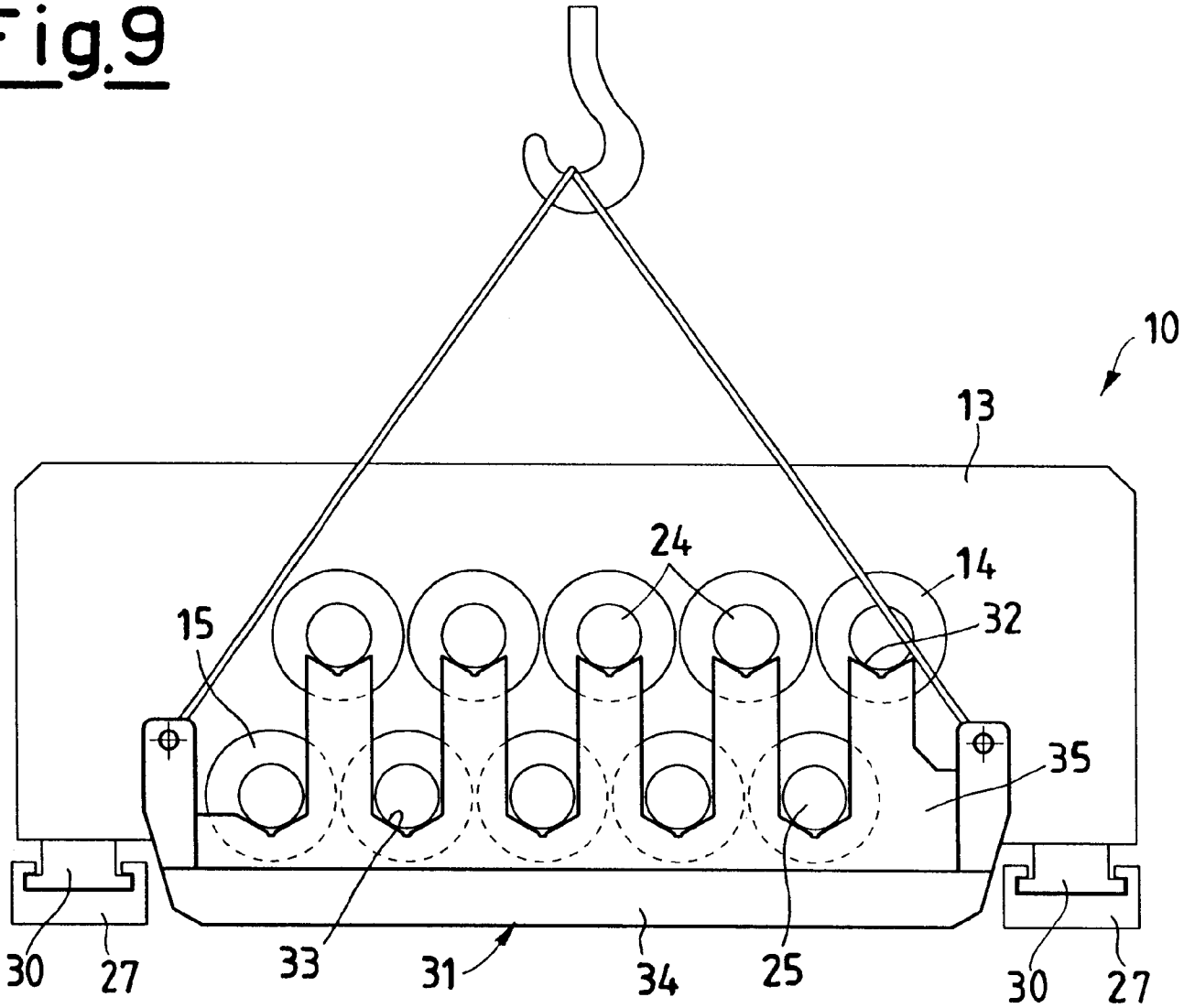
FIG. 9 is a schematic side view illustrating the roll-change phase.

In this latter position, the sets of rolls 14, 15 are supported by a container 31 (FIGS. 7 and 8) provided with cradles 32, 33, on which rest the shafts 25, 24 having necks that have a shape that is partially cylindrical and partially that of a truncated cone of the rolls 14, 15 (FIG. 9)

The said container 31, appropriately shaped, with a base 34, sides 35—from which the aforementioned cradles 32, 33 are obtained—and heads 36, has the purpose of supporting the top rolls 14 and bottom rolls 15 during the phases of assembly and disassembly of the rolls themselves.

The rolls are positioned with the cylindrical necks (cylindrical part of the shafts 24, 25) resting on the supports (cradles 32, 33) made in the container 31, the shoulders 12, 13 are brought close to one another until the conical parts of the shafts of the rolls enter the seats of the bushings, and once assembly is completed, the necks of the rolls do not rest on the supports of the container.

The assembly position is with maximum opening of the gap between the cylinders in the case of FIG. 3, and with minimum opening in the case of FIG. 10.

In the disassembly phase, the rolls are positioned with their axes set at a distance apart in such a way that during opening of the shoulders, with the sliding of the conical surfaces, the rolls will not be forced to effect an excessively large free travel between the housing in the shoulders and the supports made in the container 31.

The container 31 carrying the rolls, as shown in FIG. 9, is removed, for example with the aid of an overhead travelling crane, so as to free the space between the shoulders 12, 13, where two new sets of rolls will be positioned, the said new sets of rolls also being carried by a container 31.

Next, the shoulders 12, 13 will be re-closed in the operative positions illustrated in FIGS. 5 and 6.

It should be noted that, according to the invention, the bearings 22, 23, on which the sets of rolls 14, 15 turn, in the course of the roll-replacement operation remain in place in the shoulders 12, 13, with consequent facilitation of the entire manoeuvre, a fact which in turn leads to a considerable saving in system costs.

According to the present invention, the supports 23 (bearings) of the bottom rolls 15 (FIGS. 3, 4 and 4A) or, alternatively, the supports of the top rolls 14 (FIG. 10) are fixed to one end of stays 37, which are integrally fixed to the shoulders 12, 13 in a position-adjustable way by vertical translation in the direction of the double-headed arrow 38. At the opposite end to the rolls, the stays 37 have a threaded section 37A coupled to a female thread 42.

Translation of each stay 37 in the direction indicated by the double-headed arrow 38 is governed by means of a motor 39-reducer 40 assembly of its own via a mechanism which may be of any type suitable for the purpose.

In the example shown, the mechanism is of the type made up of an external thread 37A and female thread 42, whilst rotation of the stay 37 is prevented. Rotation of the female thread 42 is governed by means of a worm screw 41, which receives motion from the assembly 39–40 and which is coupled to a circumferential toothing 41A of the female thread 42 itself.

In this way, a system of forces, as indicated by the arrows 43, 44 in the diagram of FIG. 4A, is identified between three rolls—for example, a top roll 14 and two bottom rolls 15. The above system of forces closes on the shoulder 12, 13, so that the shafts and supports of the rolls themselves positively offset the loads that tend to divaricate them, thus eliminating the aforesaid drawbacks presented by the known art.

As may be clearly seen from the drawings, the motion for adjustment of the position of the rolls is transmitted by the motor 39-reducer 40 assembly directly to the bearings 22 mounted on the shoulder 12 and, by means of a joint represented schematically by 45, to the bearings 23 mounted on the shoulder 13.

In this way, the purposes mentioned in the preamble of the description are achieved.

The scope of the invention is defined by the ensuing claims.

What is claimed is:

1. An improved straightener for rolled ferrous products of the type having a framework comprising a pair of opposed shoulders which support two sets of rolls, a top set of rolls and a bottom set of rolls, a straightening path between said two sets of rolls for straightening said rolled ferrous products, characterized in that said opposed shoulders are capable of being translated horizontally between a closed, operative, position of containment and support of said rolls and an open, non-operative, position, in which said sets of rolls are removable for replacement with other sets of different rolls, the improvement comprises:

(a) a respective bearing upon which each roll of said rolls is mounted, whereby said bearings are fixed to the end of stays, which are integrally fixed to said shoulders and remain in place in said shoulders when opened;

(b) a container, independent of the framework, for supporting said sets of rolls in said open, non-operative, position of the shoulders; and (c) a transmission mechanism of a motor-reducer assembly with an external and a female thread to prevent rotation of the stay and permit motion to the female thread via a worm screw.

2. An improved straightener for rolled ferrous products as recited in claim 1, in which the container comprises:

a base with sides and heads; and cradles for supporting a plurality of shafts of said rolls.

3. An improved straightener for rolled ferrous products as recited in claim 1, in which the bearings are mounted on said shoulders in a position-adjustable way by vertical translation to vary the distance (gap) between the rolls.

4. An improved straightener for rolled ferrous products as recited in claim 3, in which the vertical translation adjustable position of each stay is governed by a motor-reducer assembly of its own via a transmission mechanism.

5. An improved straightener for rolled ferrous products as recited in claim 1, in which said worm screw is coupled to a circumferential toothing of said female thread.

6. An improved straightener for rolled ferrous products as recited in claim 1, in which the motion from said motor-reducer assembly is transmitted directly to the bearings mounted on one shoulder, and indirectly, via a joint, to the bearings mounted on the other shoulder.

7. An improved straightener for rolled ferrous products as recited in claim 1, in which said shoulders set opposite to one another translate horizontally on rails by means of feet.

* * * * *